United States Patent [19]

Dech

[11] Patent Number: 4,714,117

[45] Date of Patent: Dec. 22, 1987

[54] DRAINHOLE WELL COMPLETION

[75] Inventor: James A. Dech, Plano, Tex.

[73] Assignee: Atlantic Richfield Company, Los Angeles, Calif.

[21] Appl. No.: 40,419

[22] Filed: Apr. 20, 1987

[51] Int. Cl.[4] ..... E21B 33/124; E21B 33/13

[52] U.S. Cl. ..... 166/380; 166/50; 166/187; 166/191; 166/242; 166/387

[58] Field of Search ..... 166/398, 369, 187, 50, 166/179, 185, 191, 242, 380, 297, 289, 313; 175/62

[56] References Cited

U.S. PATENT DOCUMENTS

| | | | |
|---|---|---|---|
| 2,271,005 | 1/1942 | Grebe | 166/50 X |
| 2,798,435 | 7/1957 | Armstrong | 166/384 X |
| 3,542,127 | 11/1970 | Malone | 166/187 X |
| 3,865,188 | 2/1975 | Doggett et al. | 166/187 X |
| 3,918,522 | 11/1975 | Suman, Jr. | 166/187 X |
| 4,230,180 | 10/1980 | Patton et al. | 166/191 X |
| 4,248,302 | 2/1981 | Churchman | 166/50 X |
| 4,258,788 | 3/1981 | Patton et al. | 166/185 |

*Primary Examiner*—James A. Leppink
*Assistant Examiner*—Hoang C. Dang
*Attorney, Agent, or Firm*—Roderick W. MacDonald

[57] ABSTRACT

A method for completing a drainhole wellbore with casing but without conventional cementing of the casing wherein in the drainhole portion of the wellbore a casing string composed of alternating casing subs and external casing packer subs is employed, the external casing packer subs carrying an elastic member adapted to be expanded and form a seal between the exterior of the casing string and the wellbore wall, and one or more of the external casing packer subs is activated to expand the elastic member carried by same thereby providing for isolation of discreet segments of the casing string in the drainhole portion of the wellbore to allow for localized production and remedial treatments in the drainhole wellbore.

4 Claims, 12 Drawing Figures

DRAINHOLE WELL COMPLETION

BACKGROUND OF THE INVENTION

Drilling of essentially vertical wellbores into the earth to penetrate subsurface geologic formations containing desirable minerals such as oil, gas, coal, uranium, sulfur, and the like is well known. A large number of minerals bearing formations in the earth are horizontal or essentially horizontal, i.e., within 45° of horizontal, with the earth's surface. A technique has been devised which is well known in the art as "Drainhole Drilling" wherein the vertical wellbore is rapidly turned into a horizontally or essentially horizontally extending wellbore so that the drainhole portion of the wellbore can be extended outwardly within the essentially horizontal formation a substantial distance. This provides for better drainage of the mineral bearing formation since the wellbore rather than just penetrating through the thickness of the formation as would be done with a vertical wellbore, actually extends a substantial distance within the mineral bearing reservoir or formation itself.

A goal when initially completing a drainhole wellbore is to obtain adequate essentially horizontal isolation of the drainhole portion of the wellbore within the productive formation. This goal is desired in order to maximize the useability of the wellbore for future production of minerals and for future remedial operations to be carried out within the wellbore itself so as to enhance the productive life of the well. Currently, in essentially vertical wellbores, the primary method for obtaining vertical isolation of the wellbore in the productive zone of the formation is to run steel casing into the wellbore and inject cement in the annulus which extends between the exterior of the casing and the wellbore wall. This casing and cementing technique allows for individual productive intervals to be perforated, treated, and later squeezed with cement, in needed, without adversely affecting other productive zones along the wellbore length. Put another way, this technique gives vertical zone isolation in vertical wellbores. However, when this technique is applied to drainhole wellbores, adequate horizontal isolation within the productive formation is rarely achieved. This is so because in the drainhole wellbore context gravity is working against the uniform displacement of cement around the annulus outside the casing rather than helping such cement distribution as it does in the vertical wellbore context.

A major problem encountered in employing the casing-cementing completion method in a drainhole wellbore is the very low probability of obtaining a successful cementing job. Because of the effects of gravity, obtaining uniform cement displacement around the casing, which has to be accomplished in order to obtain the desired isolation of productive zones along the drainhole wellbore length, becomes progressively more difficult as the wellbore approaches horizontal. This is because in a drainhole wellbore gravity causes (1) the cement to channel through and not completely displace the drilling mud in the casing annulus due to the different densities of the mud and cement, and (2) the casing strip itself to lay on the lower side of the wellbore thereby decentralizing the casing so that cement cannot uniformly be displaced completely around the casing itself. These effects can lead to incomplete isolation in the casing annulus to an extent that makes it uneconomical in most cases even to attempt to achieve horizontal isolation in a drainhole wellbore with the casing-cementing technique.

As a result, nearly all drainhole wellbores are completed with an uncased, open wellbore in competent productive formations, or some type of slotted liner in unconsolidated formations. However, these methods provide no isolation capability along the horizontal or drainhole portion of the wellbore and this limits greatly the possibility of future remedial operations for the drainhole portion of the wellbore. For example, these methods do not allow for easy identification and isolation of gased out or watered out sections of formation along the drainhole portion of the wellbore.

BRIEF SUMMARY OF THE INVENTION

According to this invention, there is provided a method for completing a drainhole wellbore which allows for considerable and reliable horizontal isolation of zones along the length of the drainhole portion of the wellbore. This invention provides a method for completing drainhole wellbore in a manner which provides much greater flexibility for future production and remedial operations than would an open hole or slotted liner completion or even a casing-cement completion.

In accordance with this invention, there is provided a method for completing a drainhole wellbore that has been drilled into at least one subsurface geologic formation by employing in the drainhole portion of the wellbore a casing string composed of alternating casing subs and external casing packer subs, the casing packer subs each carrying an elastic member adapted to expand away from the casing packer sub toward and into contact with the adjacent wall of the wellbore, and then activating one or more of the external casing packer subs to expand the elastic member carried by same into contact with the drainhole wellbore wall. This method isolates one or more sections of the casing string in the annulus outside the casing string and inside the wellbore.

Accordingly, it is an object of this invention to provide a new and improved method for completing drainhole wellbores. It is another object to provide a new and improved method for carrying out drainhole wellbore drilling.

Other aspects, objects and advantages of this invention will be apparent to those skilled in the art from this disclosure and the appended claims.

DETAILED DESCRIPTION OF THE INVENTION

Figure 1:
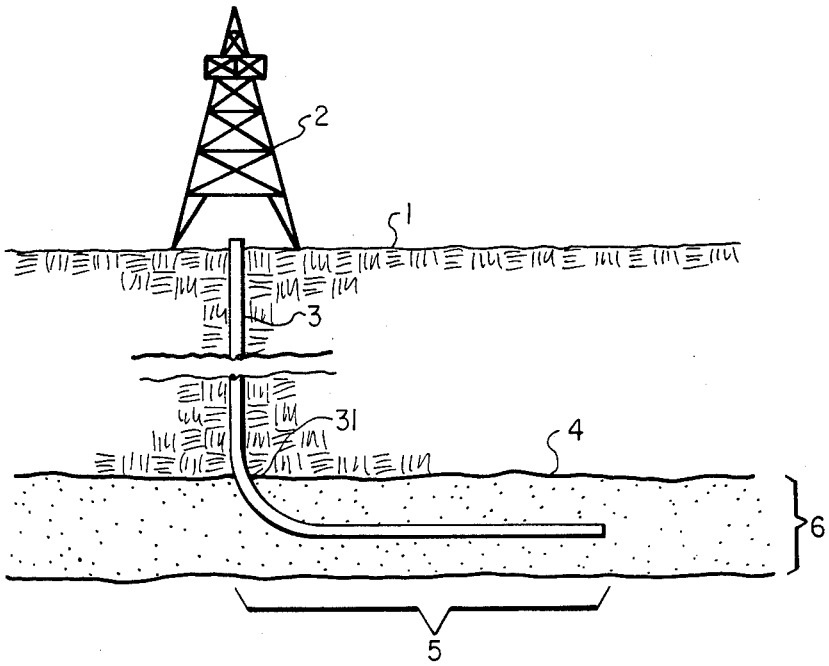
FIG. 1 shows a cross section of a vertical wellbore drilled from the earth's surface and then terminated as an essentially horizontally extending drainhole wellbore.

FIG. 1 shows the earth's surface 1 with a well drilling derick 2 thereon from which has been drilled essentially vertical wellbore 3. Wellbore 3, when it reached subsurface geologic formation 4 which contains one or more desirable minerals, was converted at 31 to an essentially horizontally extending drainhole wellbore 5. Drainhole wellbore 5 extends a substantial distance into and within formation 4 rather than just penetrating the vertical thickness 6 of formation 4 as would have happened had wellbore 3 been drilled downwardly through formation 4 in a conventional manner.

Figure 2:
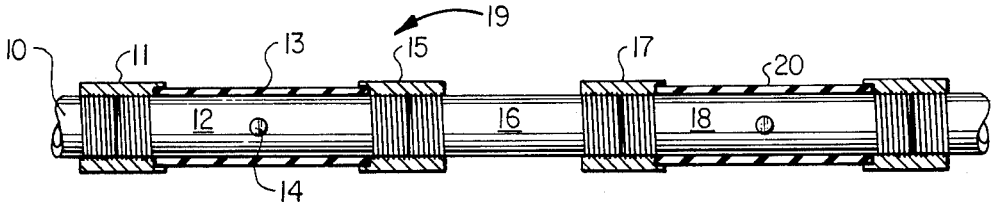
FIG. 2 shows a section of casing string within this invention.

The casing string employed by this invention is composed of alternating casing subs and external casing packer subs. This is shown in FIG. 2 wherein casing sub 10, which is simply a length of conventional casing pipe, is joined at one end by means of a conventional collar 11 to an external casing packer sub 12. External casing packer sub 12 carries on its outer surface a cylindrical elastic member 13 which can be expanded outwardly away from sub 12 by injecting a fluid such as jelled liquid, unhardened cement, diesel oil, and the like through a conventional check valve 14 into the space between the exterior of sub 12 and the interior of cylindrical member 13. This expands member 13 towards and into contact with the adjacent wall of the wellbore as will be shown in greater detail hereinafter.

External casing packers are conventional equipment that are commercially available. They are designed to be run as an integral part of a casing string and, upon activation of the elastic member, to provide a positive seal between the outer surface of the casing and the wall to the wellbore. Some models, such as certain commercially available Lynes models, incorporate an expandable metal sleeve at each end of the packer which acts as a backup for the steel ribs and cover rubber that serves as the elastic member and, when expanded, forms a permanent casing-to-formation barrier. External casing packers uniformally employ one or more check valves which are spring loaded and double sealed. The check valve opens with differential pressure and seals closed when the inflating pressure imposed on the interior of the casing string is relieved. Inflation pressures vary depending upon well conditions and pipe strength, but general inflation pressures range between 500 psig and 1500 psig.

External casing packer 12 is joined by way of coupling collar 15 to casing sub 16, which is the same or similar to casing sub 10. Casing sub 16 is joined by way of collar 17 to external casing packer 18, which is the same or similar to packer 12, and so on. Thus, the overall casing strip 19 is composed of alternate casing subs and external casing packer subs. When, for example, casing string 19 is placed in a drainhole wellbore and external casing packers 12 and 18 activated, so that elastic members 13 and 20 expand outwardly into contact with the wellbore wall, not shown, casing sub 16, in the annulus between sub 16 and the wellbore wall, will be effectively isolated between expanded elastic members 13 and 20. Thereafter, if casing sub 16 is perforated to establish fluid communication with the exterior of the casing string, only fluid leaving the wellbore wall outside of sub 16 will penetrate through the perforations in sub 16. Put another way, no other fluid outside of the casing string, for example, outside of casing sub 10, can reach the interior of casing string 19 by way of the perforations in casing sub 16. Thus, it can be seen that effective exterior isolation of casing sub 16 is achieved by activation of external casing packers 12 and 18.

Figure 3:
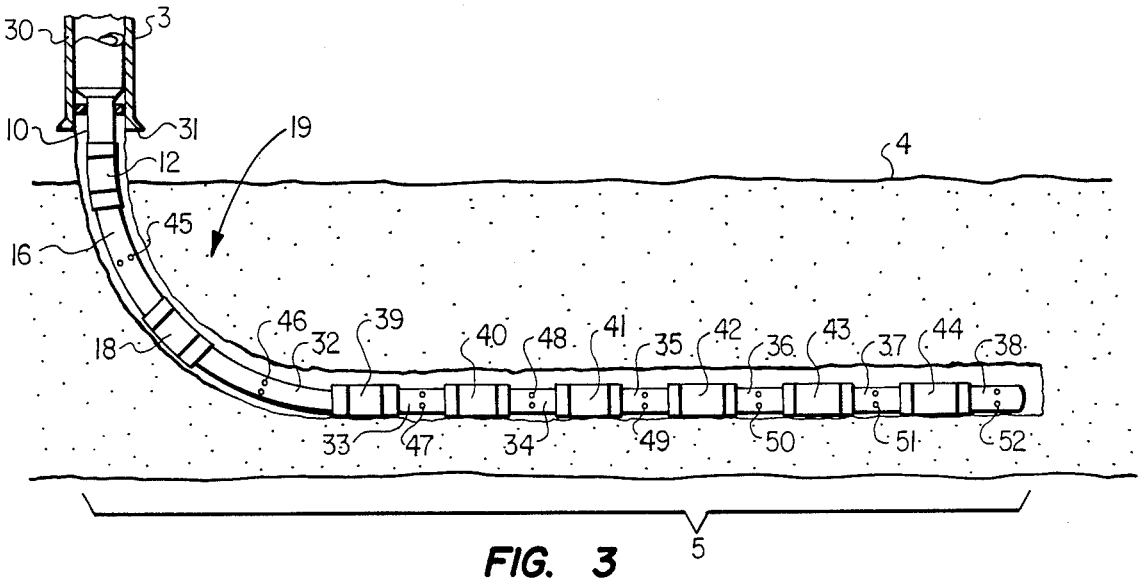
FIG. 3 shows a perforated casing string within this invention after its insertion into a drainhole wellbore.

FIG. 3 shows the bottom end of wellbore 3 and further shows steel casing 30 lining wellbore 3. Vertical casing 30 terminates at stop 31 leaving drainhole portion 5 an open hole, i.e., not cased. Inserted in open drainhole wellbore 5 is casing string 19 which is shown to be composed a plurality of alternating casing subs and external casing packer subs, the casing subs being 10, 16, and 32 through 38 while the external casing packer subs are 12, 18, and 39 through 44. Thus, by activating any pair of external casing packers, such as 40 and 41, a horizontally isolated zone the length of casing sub 34 can be created externally of casing string 19 and within drainhole wellbore 5.

In accordance with one aspect of this invention, a casing string as shown in FIG. 3 is prepared, and the casing subs 16 and 32 through 38 are perforated before the casing string is inserted into the wellbore. In FIG. 3, the perforations in each casing sub are identified as hole pairs 45 through 52. In accordance with this embodiment of the invention, an already perforated casing string is inserted in the drainhole wellbore as shown in FIG. 3. Thereafter, one or more or all of the external casing packers can be activated to form as many isolated zones within drainhole wellbore 5 as there are casing subs. The external casing packers can be activated one at a time and selectively so as to create only one isolated zone or a plurality of isolated zones depending on the type of future production and remedial work desired to be carried out in wellbore 5 from within casing string 19. It should be noted that with the activation of only external casing packer 44, an isolated zone coextensive with casing sub 38 can be created so that in not all cases does this invention require the activation of a pair of external casing packers to create the desired isolated zone.

Figure 4:
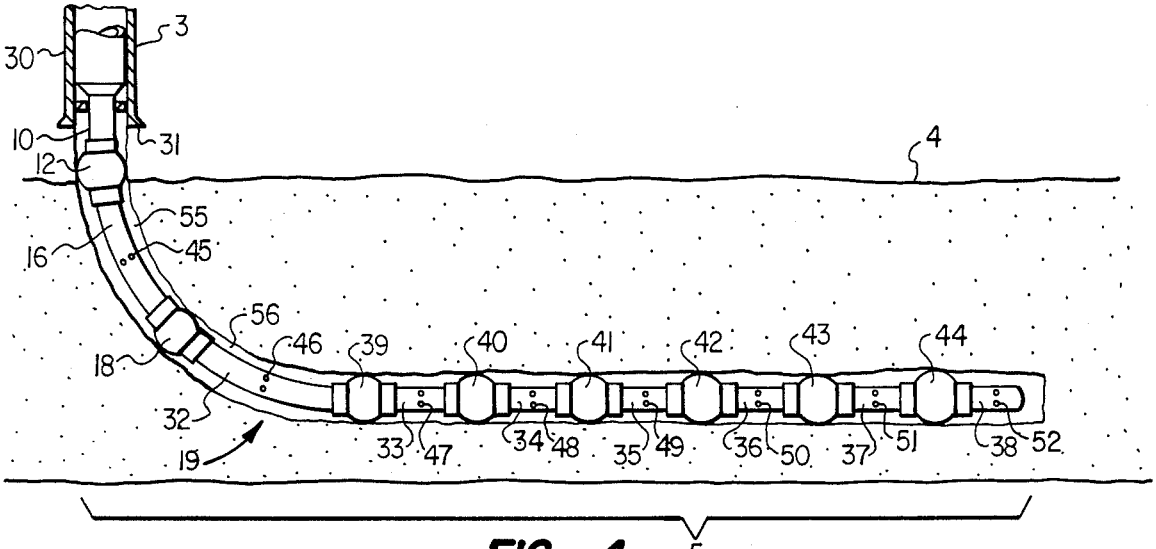
FIG. 4 shows the casing string of FIG. 3 after activation of the elastic members carried on the external casing packer subs of the casing string.

FIG. 4 shows casing string 19 after all external casing packers have been activated to create eight isolated zones exteriorally of drill string 19 in the drainhole portion of the wellbore. For example, in annulus 55, which extends around the outer surface of casing sub 16 and inside drainhole wellbore 5, there is an isolated zone because the elastic members of external casing packers 12 and 18 are firmly pressed against the wellbore wall at either end of casing sub 16. This way, any fluid that passes from formation 4 into annulus 55 can only reach the interior of drill string 19 by way of perforations 45 and cannot gravitate downwardly to annulus 56 around casing sub 32 because of the blockage formed by the expanded elastic member of external casing sub 18. Accordingly, the desirable effect of a cased and cemented well casing is obtained by the method of this invention as illustrated in FIG. 4 but without the use of cement.

Figure 5:
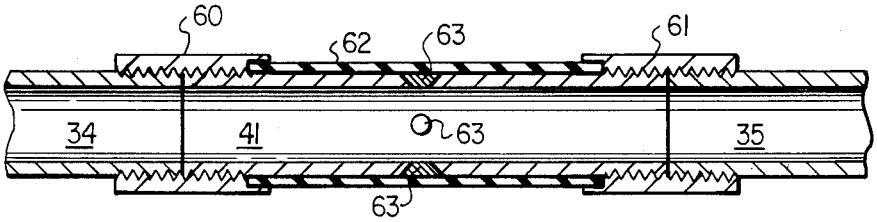
FIG. 5 shows a cross section of an external casing packer sub of FIG. 3 disposed between two casing subs in accordance with this invention.

FIG. 5 shows external casing packer 41 joined to casing subs 34 and 35 by conventional collars 60 and 61. Collars 60 and 61 also hold down the opposing ends of cylindrical elastic member 62. Fluid in the interior of external casing packer 41 can reach the interior of elastic member 62 by way of one or more check valves 63 if the fluid is at a suitably elevated pressure. External casing packer sub 41 is, therefor, activated by introducing into the interior of casing string 19 a fluid at a sufficient pressure to overcome the spring bias of check valve 63. The pressurized fluid then reaches the interior of elastic member 62 and forces same away from external casing sub 41 towards the adjacent wall of the wellbore. This activation step can be accomplished in many known ways. For example, coiled tubing an a straddle packer of well known and conventional configuration can be so employed.

Figure 6:
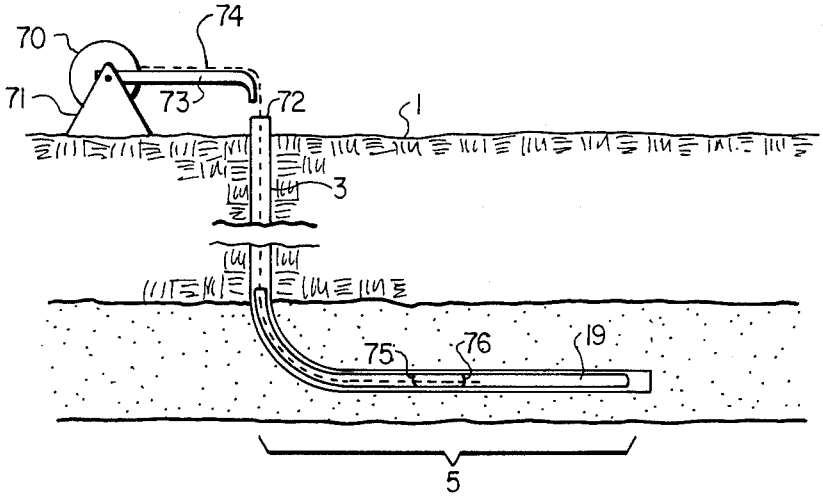
FIG. 6 shows coiled tubing apparatus for use in inserting a straddle packer into the casing string of FIG. 3.

FIG. 6 shows conventional coiled tubing apparatus comprising a coil of tubing 70 supported by a base 71 and carried over to a wellbore opening 72 by an extended arm 73. The coiled tubing represented by dotted line 74 passes from coil 70 over arm 73 down through vertical wellbore 3 into casing string 19. The straddle packer used for activating an individual external casing packer is carried near the end of coiled tubing 74 and is represented by its sealing elements 75 and 76 in FIG. 6.

Apparatus for employing coiled tubing is known in the art, for example, see U.S. Pat. No. 4,476,945 issued Oct. 16, 1984.

Figure 7:
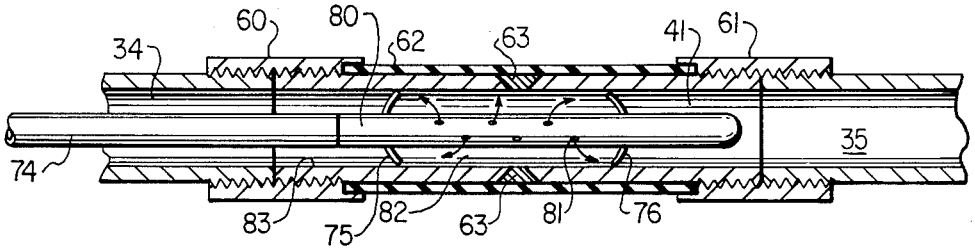
FIG. 7 shows the section of casing string of FIG. 5 with a straddle packer disposed in the interior thereof for the purpose of activating the elastic member of the external casing packer.

As shown in FIG. 7, staddle packer 80 is a sub carried by coiled tubing 74 which has a plurality of perforations 81 therein between one or more pairs of chevron seal means 75 and 76. After straddle packer 80 is inserted into the interior of external casing packer 41 with its seal means 75 and 76 bracketing check valves 63, fluid can be passed from the earth's surface through the interior of coiled tubing 74 into the interior of straddle packer 80 and out through apertures 81 into annulus 82 between the exterior of straddle packer 80 and the inner wall 83 of external casing packer 41. This pressurized fluid then forces seal means 75 and 76 against the inner surface 83 of external casing packer 41 to provide a fluid tight seal and to build up the pressure between seal means 75 and 76 to an extent adequate to overcome the spring bias of check valves 63 and allow additional pressurized fluid from the interior of straddle packer 80 to press against the inner side of elastic member 62. This expands elastic member 62 into contact with the wellbore wall adjacent thereto as shown in FIG. 8.

Figure 8:
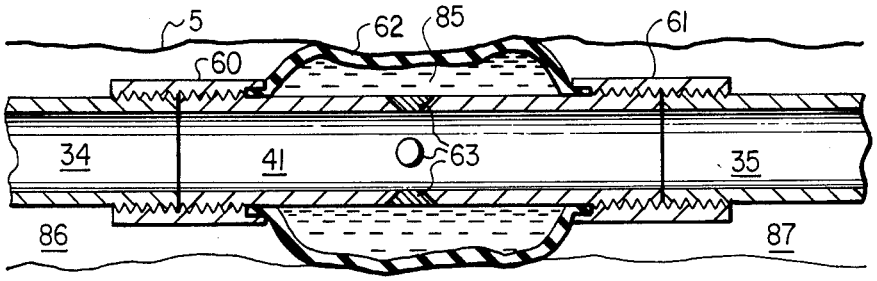
FIG. 8 shows the section of casing string of FIG. 5 after the elastic member of the external casing packer has been activated.

FIG. 8 shows the apparatus of FIG. 7 with straddle packer 80 removed for sake of clarity, but with the fluid 85 remaining trapped by closed check valve 63 between the inner surface of elastic member 62 and the outer surface of external casing packer 41. It can be seen that by using pressurized fluid 85 to expand elastic member 62 into intimate contact with the adjacent wall of drainhole wellbore 5, an effective barrier was formed between annulus 86 outside casing sub 34 and annulus 87 outside casing sub 35. By moving straddle packer 80 from external casing packer to external casing packer of FIG. 3, the final configuration as shown in FIG. 4 can be obtained. Of course, in accordance with this invention, not all external casing packers need be activated at the same time so that only one external casing packer or one or more pairs of external casing packers in FIG. 3 need be activated at any given time thereby leaving a plurality of unactivated external casing packers that can be activated at a later time should a larger number of horizontally isolated zones be desired for any number of production or work over reasons.

Figure 9:
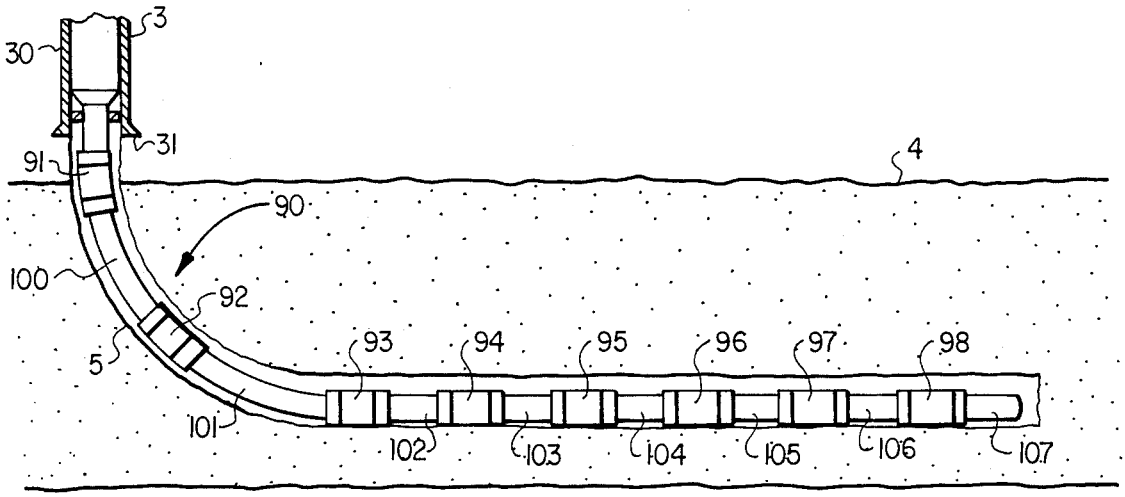
FIG. 9 shows a solid, unperforated casing string within this invention disposed in a drainhole wellbore.

The casing string used in this invention need not have any of its casing subs perforated before the casing string is run into the wellbore. This is illustrated in FIG. 9 wherein casing string 90 is shown to be composed of a plurality of alternating external casing packer subs 91 through 98 and solid, unperforated casing subs 100 through 107. The external casing packers 91, etc. in casing string 90 can have the same configuration as shown for external casing packer 41 of FIG. 5. However, in this embodiment of the invention, rather than activating individual external casing packers one at a time with a straddle packer as shown in FIG. 7, all external casing packer subs are activated at essentially the same time by injecting from the earth's surface a fluid such as cement or jelled liquid or gas into the interior of casing string 90 by way of tubing 108 and pack off 109 in casing 30.

Figure 10:
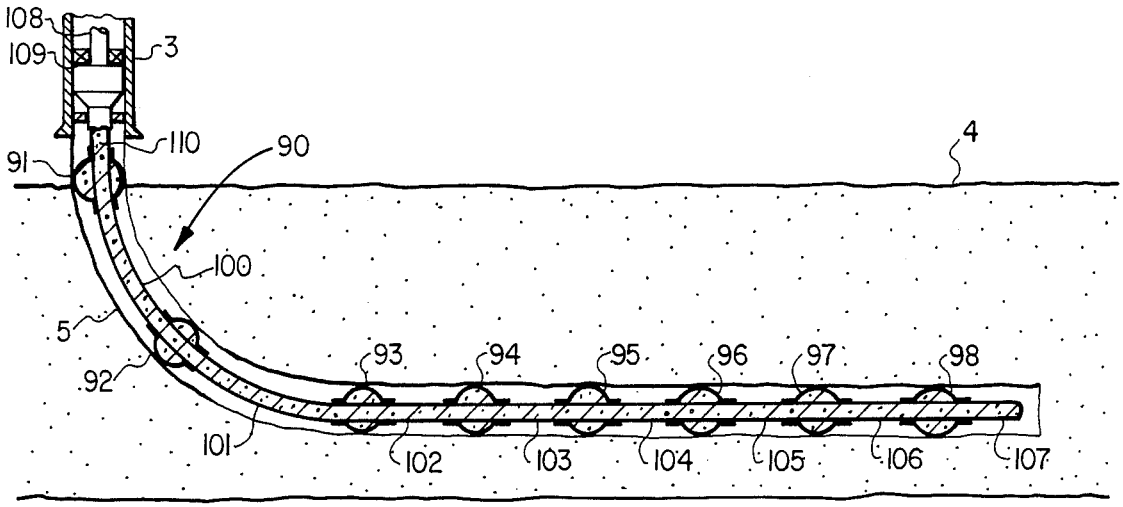
FIG. 10 shows a cross section of the casing string of FIG. 9 after the casing string has been filled with a fluid to activate all of the elastic members of the external casing packer carried by that casing string.

For example, in FIG. 10, fluid 110 composed primarily of an uncured cementitious is forced down the interior of tubing 108 into the interior of casing string 90 with sufficient pressure to activate all of external casing packers 91 through 98. After the activating step is terminated and tubing 108 and pack off 109 removed, casing string 90 is left filled with hardening cement as shown in FIG. 10. Thereafter, conventional drilling equipment is inserted in casing 30 and the hardened cement 110 in the interior of casing string 90 is drilled out to again form a hollow section of pipe in the interior of drainhole 5 except that hardened cement is left in the space between the expanded elastic members of each external casing packer sub and the external surface of those subs as shown for fluid 85 in FIG. 8.

Figure 11:
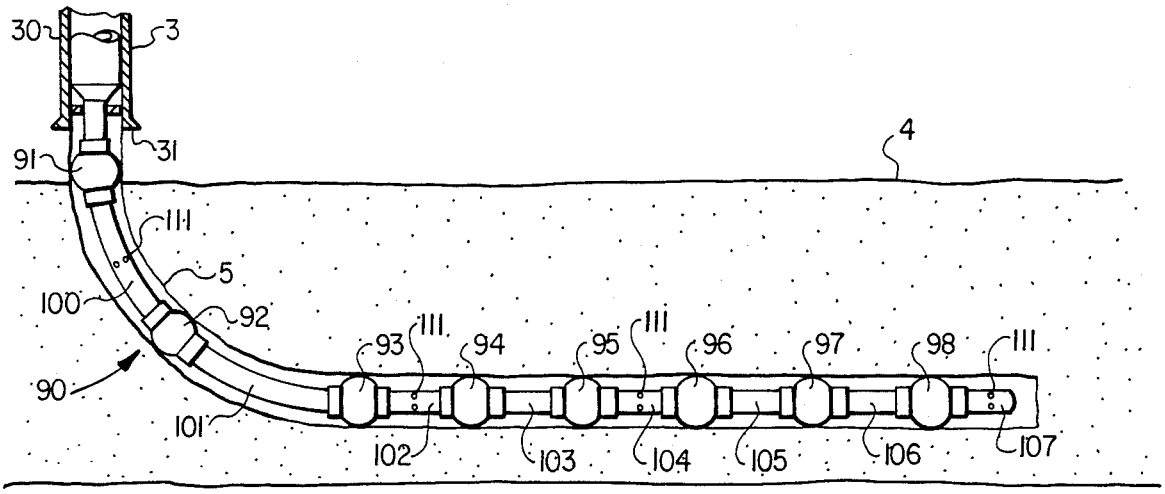
FIG. 11 shows the casing string of FIG. 10 after removal of the activating fluid of the interior of the casing string, a perforation of selected isolated zones thereof.

As shown in FIG. 11, after the hardened cement 110 is drilled out from the interior of casing string 90, any one or more individual subs can be perforated and any one or more of such subs can be left unperforated, the embodiment of FIG. 11 showing subs 100, 102, 104, and 107 perforated by holes 111.

Generally, any fluid which will activate the check valves of the external casing packers and which will remain in place between the elastic member and the external casing packer to provide a good tight seal between the elastic member and the wall of the wellbore can be used in this invention. This includes suitable gases such as air as well as liquids or fluidized material such as cement. Generally, jelled water or jelled hydrocarbon liquids such as crude oil or diesel fuel can be used. The jelling agent can be any material which renders the liquid more viscous and which is not deleterious to the elastic member or metal from which the external casing packer is formed. Any cementing material normally employed in well completions can be employed in this invention.

EXAMPLE

Figure 12:
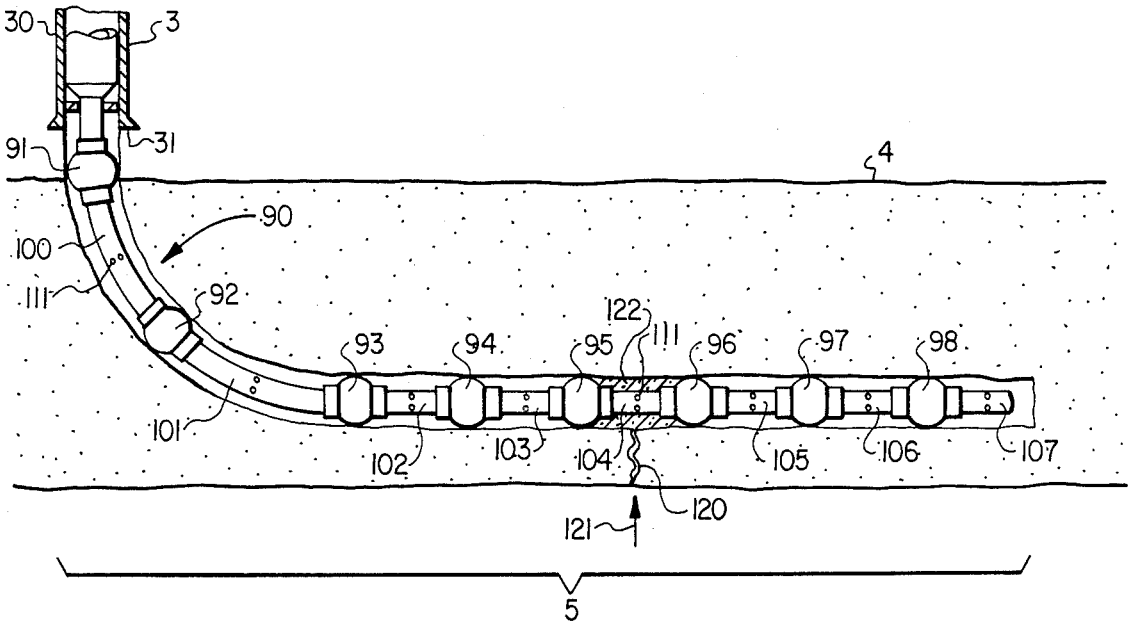
FIG. 12 shows one application of the method of this invention wherein a horizontally isolated section of the drainhole portion of a wellbore is cemented off to prevent ingress of water into the interior of the casing string.

A conventional vertical wellbore 3 is drilled down to just above a producing formation 4 as shown in FIG. 12 and then lined with steel casing 30 from the earth's surface to point 31 after which drainhole wellbore 5 is drilled from the bottom of the wellbore 3 a substantial distance within producing formation 4 as shown in FIG. 12. Thereafter, casing string 90 is inserted in drainhole wellbore 5 and external casing packer subs 91 through 98 activated by use of a straddle packer and cement slurry to yield the configuration shown in FIG. 12. Casing string 90 inserted into wellbore 5 had each of its casing subs perforated as represented by hole pairs 111. The well can then be put onto production for removal of crude oil from formation 4 to the earth's surface for recovery and other disposition. Should water be found to be encroaching into the oil produced to the earth's surface from this well, each zone 100 through 107 can be checked for water production. Fracture 120 in formation 4 allows water as represented by arrow 121, from outside formation 4 to migrate through formation 4 into wellbore 5 in the vicinity of casing sub 104. In such a situation, testing of each isolated casing sub 100 through 107 will indicate which section is admitting the water. After it is determined that it is isolated casing sub section 104 that is leaking water, that isolated section can be plugged with cement 122 by use of the straddle packer technique, described with reference to FIG. 7, to stop such water flow.

By use of the completion method of this invention, very localized remedial work can be carried out where premature and unacceptable gas, water, or other encroachment occurs, thereby leaving the majority of unaffected sections of wellbore 5 free for maximum production.

This, it is clear from the foregoing that individual localized zones within the drainhole wellbore can, in accordance with this invention, be treated individually or can be production tested individually to determine water-oil ratios or gas-oil ratios to determine which zones along the casing string are producing best, and which, if any, are contributing unwanted fluids that should be blocked off by individual treatment of the offending zone.

Reasonable variations and modifications are possible within the scope of this disclosure without departing from the spirit of this invention.

What I claim is:

1. In a method for completing a curved drainhole wellbore defined by a wall formed by drilling into at least one subsurface geologic formation, the improvement comprising inserting into said drainhole wellbore a casing string composed of alternating casing subs and external casing packer subs, each of said casing subs being solid and not perforated when said casing string is inserted into said wellbore, each of said external casing packer subs carrying an elastic member adapted to expand away from said casing packer sub toward and into contact with the adjacent wall of said drainhole wellbore, whereby, except for the end most casing sub, each said closing sub carries first and second external casing packer subs on either end thereof so that upon expansion of said elastic members carried by said first and second external casing packer subs the intermediate casing sub is isolated in the annulus outside said casing string assembly and inside said drainhole wellbore, and activating said external casing packer subs by pumping an activating fluid into said casing string to expand essentially all elastic members on said casing string at essentially the same time by expanding the elastic member into contact with said drainhole wellbore wall thereby to form isolated zones along said casing string, said isolated zones extending from outside said casing string to said drainhole wellbore wall, and thereafter perforating at least one of said solid casing subs to establish fluid flow contact between the interior of said casing string and said geologic formation.

2. The method of claim 1 wherein said activating fluid is cementitious.

3. The method of claim 2 wherein said cementitious fluid is left in the interior of said casing string as well in said elastic members and after said cement has hardened the interior of said casing string is drilled out to establish communication once again throughout the length of the interior of said casing string while leaving said elastic members full of hardened cement.

4. The method of claim 3 wherein after drilling out the interior of said casing string at least one of said solid casing subs is perforated to establish fluid flow contact between the interior of said casing string and said geologic formation.

* * * * *